US008757447B2

(12) United States Patent
Gill et al.

(10) Patent No.: US 8,757,447 B2
(45) Date of Patent: Jun. 24, 2014

(54) SPRAY DEVICE

(75) Inventors: Carolina Gill, Dublin, OH (US); Blain Lilly, Columbus, OH (US); Thornton K. Lothrop, Worthington, OH (US); Scott Shim, Dublin, OH (US); Lara B. McKenzie, Bexley, OH (US); Kristin J. Roberts, Columbus, OH (US); Nicolas G. Nelson, Columbus, OH (US)

(73) Assignees: Nationwide Children's Hospital, Inc., Columbus, OH (US); The Ohio State University, Columbus, OH (US)

( * ) Notice: Subject to any disclaimer, the term of this patent is extended or adjusted under 35 U.S.C. 154(b) by 301 days.

(21) Appl. No.: 13/287,430

(22) Filed: Nov. 2, 2011

(65) Prior Publication Data

US 2013/0105523 A1 May 2, 2013

(51) Int. Cl.
*B05B 11/00* (2006.01)

(52) U.S. Cl.
CPC ..... *B05B 11/0027* (2013.01); *B05B 11/3011* (2013.01); *B05B 11/3059* (2013.01)
USPC ..... 222/153.13; 222/1; 222/384; 222/153.02

(58) Field of Classification Search
CPC ..... B05B 11/0027; B05B 11/3011; B05B 11/3059
USPC ..... 222/1, 153.01, 153.02, 153.13, 153.14, 222/383.1, 384
See application file for complete search history.

(56) References Cited

U.S. PATENT DOCUMENTS 4,366,921 A 1/1983 Kirk, Jr.
4,506,805 A * 3/1985 Marcon ..... 222/153.13
(Continued)

FOREIGN PATENT DOCUMENTS

JP 11-244749 9/1999
JP 2000-070791 7/2000

OTHER PUBLICATIONS

US Consumer Product Safety Commission website; http://www.cpsc.gov/businfo/pppaguid/packtypeindex.html Child Resistant and Senior-Friendly Packages—2006; 5 pages.

(Continued)

*Primary Examiner* — J. Casimer Jacyna
(74) *Attorney, Agent, or Firm* — Jason H. Foster; Kremblas & Foster

(57) ABSTRACT

A fluid container spray device having a trigger lock mechanism with trigger tabs extending outwardly from the trigger and cleats extending inwardly from a moveable shroud. The cleats obstruct the tabs when the shroud is in a trigger lock position. A lever extending from beneath the shroud can be depressed, thereby moving the shroud from the trigger lock position to a trigger release position. The movement of the shroud to the trigger release position moves the connected cleats from their obstructive position to a position out of the trigger tabs' path of movement, thereby permitting use of the trigger to pump fluid from the container. The shroud is biased toward the trigger lock position. Thus, release of the container by the user restores the locked configuration, thereby preventing use by children.

20 Claims, 8 Drawing Sheets

(56) References Cited

U.S. PATENT DOCUMENTS

| | | | |
|---|---|---|---|
| 5,114,049 | A | 5/1992 | Knickerbocker |
| 5,228,600 | A | 7/1993 | Steijus et al. |
| 5,615,835 | A | 4/1997 | Nelson |
| 5,687,880 | A | 11/1997 | Maas et al. |
| 5,716,008 | A | 2/1998 | Nottingham et al. |
| 5,823,396 | A | 10/1998 | Vollmerhaus et al. |
| 6,003,738 | A | 12/1999 | Foster et al. |
| 6,244,469 | B1 | 6/2001 | Knickerbocker |
| 6,669,058 | B1 | 12/2003 | Sweeton |
| 6,669,061 | B2 | 12/2003 | Tada |
| 6,845,922 | B2 | 1/2005 | Stark |
| 7,032,777 | B2 | 4/2006 | Good et al. |
| 7,472,806 | B2 | 1/2009 | Good |
| 2009/0308892 | A1 | 12/2009 | Clark |
| 2010/0051652 | A1 | 3/2010 | Becker |

OTHER PUBLICATIONS

US Consumer Product Safety Commission website; Pump Dispenser, Trigger; IXB(1); Continental AFA Dispensing Company; 2 pages; 0176 CR; http://www.cpsc.gov/businfo/pppaguid/continentalafa.pdf.

US Consumer Product Safety Commission website; Pump Dispenser, Trigger; IXB; Guala Dispensing S.p. A.; 2 pages; Ts1; http://www.cpsc.gov/businfo/pppaguid/gualadispensing.pdf.

US Consumer Product Safety Commission website; Pump Dispenser, Trigger; IXB; Guala Dispensing S.p. A.; 3 pages; Ts3; http://www.cpsc.gov/businfo/pppaguid/gualadispensingts3.pdf.

US Consumer Product Safety Commission website; Pump Dispenser, Trigger; IXB(1); Saint Gobain Calmar; 2 pages; Mixor HP; http://www.cpsc.gov/businfo/pppaguid/saintgobaincalmarmixor.pdf.

* cited by examiner

SPRAY DEVICE

BACKGROUND OF THE INVENTION

The invention relates generally to spray devices for containers, and more particularly to structures combined with spray devices that render the spray devices safer by restricting use of the spray devices to those who are responsible to handle the contents of the containers.

Most conventional spray devices for household cleaning and other fluids include pumps that are manually actuated by triggers to draw fluid from a container and dispense the fluid out of a nozzle. The pump mechanism is typically covered by a stationary shroud. A "spray bottle" combines a spray device with a typically small plastic container of liquid to permit a user to spray the liquid for various purposes. The research of some of the applicants has shown that over 267,000 children aged five years or younger were treated in U.S. emergency departments for injuries related to household cleaning products between 1990 and 2006. Spray bottles were the most common source of exposure, accounting for about 40 percent of all injuries related to household cleaning products.

Many spray devices include a nozzle that controls the stream configuration and/or prevents spraying of the contents of the container by rotation of the nozzle cap relative to the rest of the spray device. However, such conventional nozzles are not effective if the user does not turn the nozzle back to the "closed" or "off" position after each use. Furthermore, these nozzles are relatively easy for young children to manipulate to the "open" position. Therefore, such conventional spray bottles for household cleaning products cannot be designated as truly "child-resistant". Indeed, in a recent pilot study in which some of the Applicants conducted home observations with 25 families with young children, a total of 36 percent of all cleaning product containers in the homes were identified as spray bottles (238 spray bottles in 25 homes). Of those spray bottles, a total of 75 percent had nozzles which were found to pose a potential hazard to young children in the household because they were not stored in the "closed" or "off" position.

Trigger systems, including spray devices, are the largest dispensing system type by volume in North America, and are commonly used for window cleaning, household cleaning, lawn and garden products (including insecticides and herbicides), air fresheners and automotive cleaning products. The household and industrial chemical dispensing system market includes two billion trigger system units sold each year. Many conventional spray devices incorporate safety features. For example, ContinentalAFA Dispensing Company, Guala Dispensing S.p.A. and Saint Gobain Calmar manufacture safety features on spray devices. However, no spray devices currently on the market are sufficiently child-resistant, because most or all of them require the user to return them to the "safe" condition after use. Because of the tendency to forget to do so, many "safety" spray devices become insufficiently safe.

In recent years, consumers have become more health conscious and manufacturers have attempted to be perceived by consumers as safe and responsible with green-friendly packaging, biodegradable products, and products that are better for the environment and the consumer's family. In addition, federal regulations are making child-resistant closures mandatory for certain pharmaceutical and household cleaning packaging. However, no spray device has achieved child-resistance beyond the type that must be returned deliberately to a "safe" condition by the user.

The need exists, therefore, for a spray device that restricts spraying of the contents of the container to those who are capable of determining whether the contents should be dispensed.

BRIEF SUMMARY OF THE INVENTION

The disadvantages of the prior art are overcome by a spray device that includes a two stage trigger lock incorporated into the device. The two stages of the lock must be engaged in the proper sequence in order for the spray device to function. An improved spray device has a trigger that is manually actuated to drive a pump that pumps a fluid from a container and dispenses the fluid from a nozzle connected to the pump. The spray device has a shroud extending over at least a portion of the trigger. The improvement includes a rib extending inwardly from the shroud, and preferably ribs extending inwardly from opposing sides of the shroud. A lever is pivotably mounted to the spray device and configured to traverse a path that intersects the ribs to move the shroud from a trigger lock position to a trigger release position. In the trigger lock position, the trigger cannot be pulled and fluid in the container cannot be dispensed. In the trigger release position, the trigger can be pulled. Thus, the lever must be displaced to move the shroud to the trigger release position before the trigger can be pulled. Thus, this sequence is important in the operation of the spray device.

The improvement also includes at least one trigger tab extending from the trigger, and at least one cleat extending from the shroud in a path of the trigger tab when the shroud is in the trigger lock position. There are preferably two opposing trigger tabs extending laterally outwardly from the trigger, and there are preferably two opposing cleats extending inwardly from the shroud. The cleats are configured to be out of the trigger tab's path when the shroud is in the trigger release position to permit the trigger to be pulled, such as by displacing the shroud to which the cleats are attached. A spring is mounted in contact with the shroud for biasing the shroud toward the trigger lock position. This bias causes the spray device to default to the trigger lock position automatically when the spray device is released by a user. The spring that biases the shroud preferably comprises a leaf spring that extends downwardly from the shroud.

It is preferred that the lever is mounted to a pivot that defines a lever portion that extends out from the shroud on a first side of the pivot and a release arm portion that intersects the ribs on a second side of the pivot. In the preferred embodiment, the lever portion has a tip that extends out from beneath the shroud in the rear. A torsion spring preferably biases the lever to the rest position.

This design restricts the ability of young children to trigger spray bottles in at least two ways. First, young children lack the developmental capability to perform the correct operational sequence of pressing down the lever first and then squeezing the trigger. Second, the size and strength of a child's hand are not sufficient to activate the mechanism. The trigger lock is designed to facilitate easy use for an adult so that there is little to no temptation to defeat the lock or otherwise avoid having to use it every time the spray device is used. The two stage trigger lock automatically returns the spray device to the "locked" state after each use without any act being performed by the user. This avoids any requirement of the user to consciously apply a locking feature.

In summary, the spray device requires much more time for young children to deactivate its locking features, yet allows adults comfortable and convenient use with little additional effort. Importantly, the locking features automatically engage upon release by the user, thereby avoiding the common failure of users to reactivate the safety features. The spray device has been designed to meet all standards for child-resistant packaging.

Figure 1:
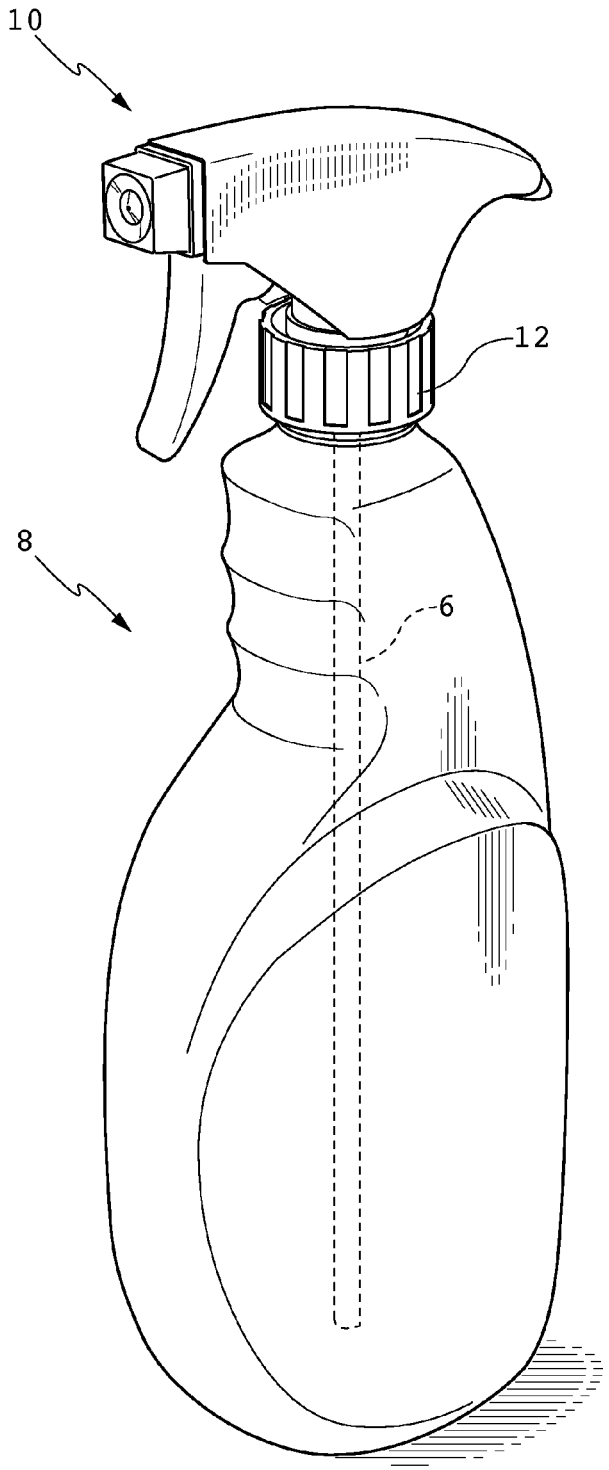
FIG. 1 is a front view in perspective illustrating an embodiment of the present invention mounted to a conventional bottle.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

The spray device 10 is shown in FIGS. 1 through 7 having a collar 12 that can be removably mounted to a container, such as the conventional bottle 8. The collar 12 is preferably an annulus with conventional, inwardly-facing threads (not visible) that engage the conventional, outwardly-facing threads of the bottle's neck to connect the spray device 10 to the bottle 8 in a known manner.

Figure 5:
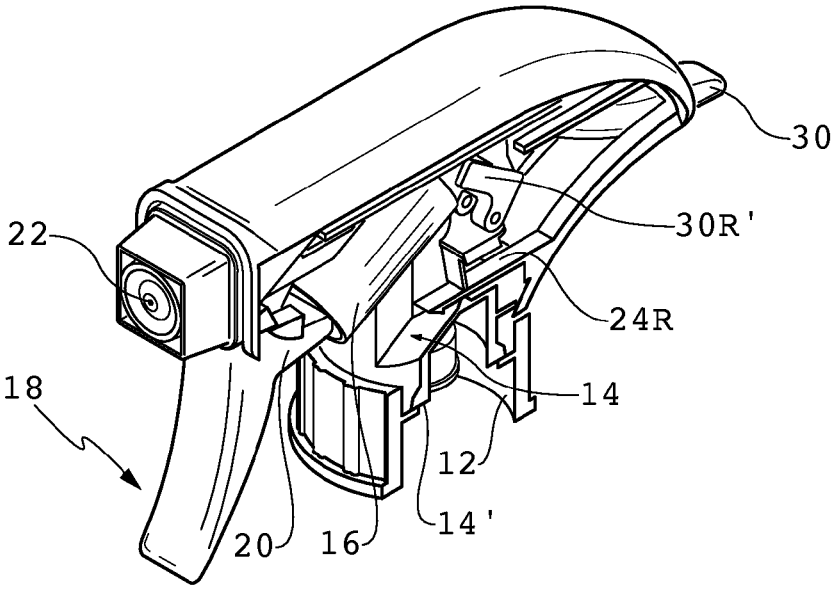
FIG. 5 is a cutaway view of the illustration of FIG. 4.
Figure 6:
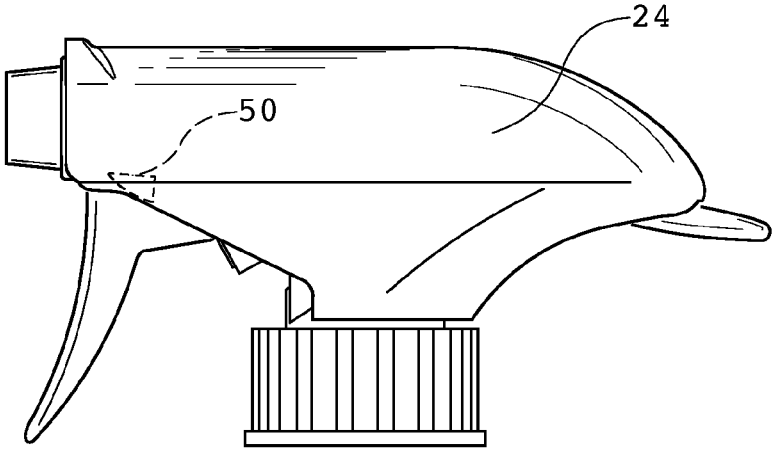
FIG. 6 is a side view illustrating the spray device of FIG. 1.

As best viewed in FIG. 5, the collar 12 extends rotatably around the lower end of a central frame 14 and is restrained by a shoulder 14' from moving beyond a limit in the axial direction (along the axis of rotation of the collar 12) on the spray device 10. This configuration permits circumferential rotation of the collar 12 around the axis due to a loose fit between the collar 12 and the shoulder 14'. The collar is preferably a rigid plastic, but could be made of any material that provides suitable characteristics. All components of the spray device are preferably made of suitably rigid plastic unless noted otherwise, but many materials can be substituted for plastic as will become apparent to the person having ordinary skill in the art.

Figure 7:
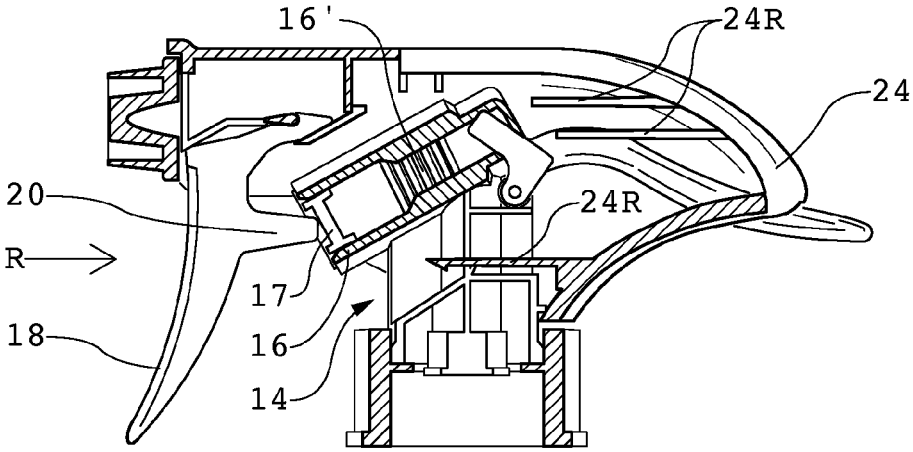
FIG. 7 is a side view in section illustrating the spray device of FIG. 6.

The spray device 10 has a pump that is actuated by a trigger 18 to draw fluid upwardly out of the bottle 8 and dispense it in a forward direction through a nozzle 22. For the sake of convenience and clarity, orientation terms such as "top," "bottom," "front," "rear," "upward", "downward", "laterally," and "longitudinally" are used herein to describe the orientation and direction of various components of the invention, all with respect to the geometry and orientation of the spray device 10 as it appears in FIG. 7. In FIG. 7, the front is to the left, the rear is to the right, and longitudinally is through a line extending from left to right. This terminology will include the words specifically mentioned, derivatives thereof, and words of similar import.

With reference to FIGS. 5 and 7, the pump in the embodiment of FIGS. 1 through 7 includes a cylindrical tube 16 with a piston 17 that is sealingly and slidably mounted in the cylindrical barrel of the tube 16. The piston 17 is driven longitudinally within the tube 16 by an arm 20 extending from the trigger 18, and a preferably coiled metal spring 16' within the tube 16. The trigger 18 is pivotably mounted at a top end, and when a sufficient rearward force (in the direction of the arrow, R in FIG. 7) is applied to the trigger 18, the lower tip of the trigger 18 passes through an arc as the arm 20 forces the piston 17 into the tube 16. Upon removal or sufficient reduction of the rearward force on the trigger 18, the spring 16' forces the piston 17 back to its original position shown in FIG. 7. This return action draws fluid into the tube 16 through the conduit 6 (see FIG. 1) extending downwardly into the bottle 8 and in fluid communication with the tube 16. This fluid is dispensed through the nozzle 22 during the next rearward movement of the trigger 18.

A shroud 24 preferably extends on both sides of the spray device 10 from just above the collar 12 to the top of the spray device 10 as shown in FIGS. 1-4. The shroud 24 is shown partially cut away in FIGS. 5 and 7 to expose the internal components of the spray device 10. The shroud 24 is preferably a thin sheet of rigid material that covers the internal components of the spray device 10 and inhibits contact with the components by the user of the spray device 10. The shroud 24 has longitudinal rails 24R extending along opposing sides that extend through slots on the frame 14 to retain the shroud 24. The rails 24R are slidably mounted within the slots to permit the shroud 24 to slide a short distance longitudinally from a first shroud position to a second shroud position, as described in more detail below. The first shroud position, in which the shroud is forward (see FIG. 12), corresponds to a locked position in which the trigger 18 cannot be moved using normal strength. The second shroud position, in which the shroud is rearward (see FIG. 13), corresponds to an unlocked or "release" position in which the trigger 18 can be pulled. The structure by which the shroud is moved between the two positions is described immediately below.

Figure 2:
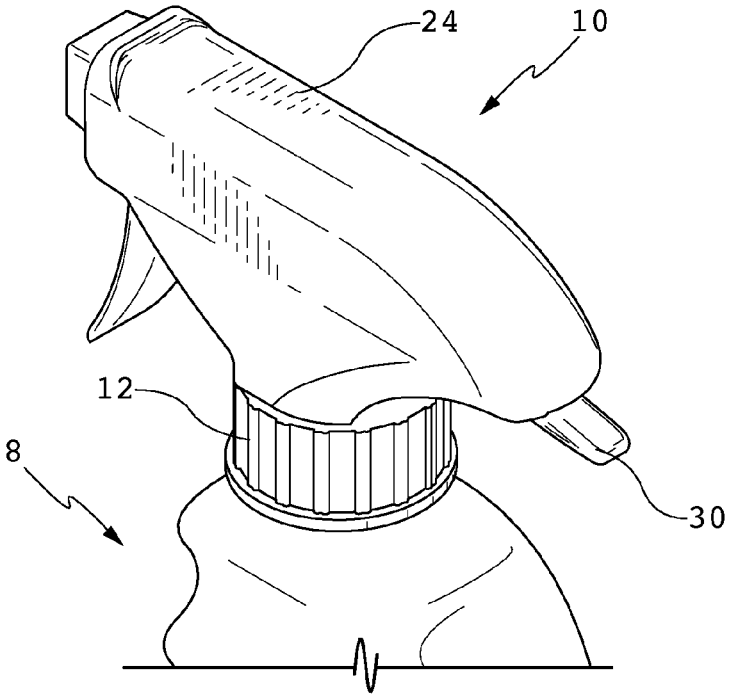
FIG. 2 is a rear, close-up view in perspective illustrating the embodiment of FIG. 1 with the lever in the resting position in which the trigger is locked.

As shown in FIGS. 7 through 16, a lever 30 is rotatably mounted to a pivot 32, which is preferably a pin extending through an aperture in the lever 30 and through an aperture in the frame 14. The lever 30 has a release arm portion 30R and a lever portion 30L. The lever portion 30L extends from the pivot 32 to the tip that protrudes out from under the shroud 24 by a small amount, such as about 2.0 centimeters, in a rearward direction, preferably opposite the nozzle. As FIG. 2 illustrates, the protruding tip of the lever 30 can be contacted by a person whose hand is drawn rearwardly over the shroud 24 and downwardly toward the collar 12. This permits the person to pivot the lever portion 30L downwardly about the pivot 32 to drive the lever portion 30L toward the collar 12 (as shown in FIG. 3), and then grip the apparatus around the collar 12 and neck of the bottle 8.

Figure 8:
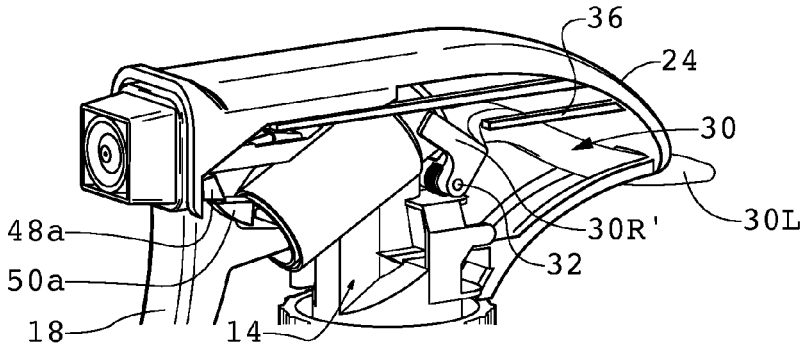
FIG. 8 is a cutaway view in perspective illustrating the spray device of FIG. 6 in the trigger lock position.
Figure 12:
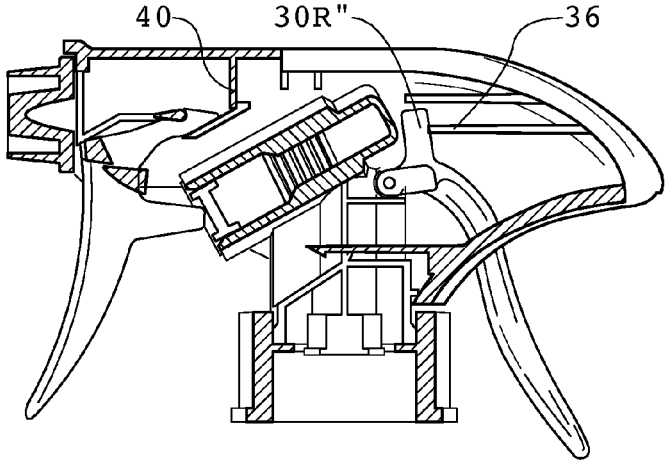
FIG. 12 is a cutaway side view illustrating the spray device of FIG. 6 in the trigger lock position.

Turning to FIG. 8, the release arm portion 30R extends integrally from the lever 30, preferably on the opposite side of the pivot 32 from the lever portion 30L. In a preferred embodiment, the release arm portion 30R is a bifurcated structure made of two minor image arms 30R' and 30R" having a gap between them. The first arm 30R' is shown in FIG. 8 and the second arm 30R" is shown in FIG. 12. There is an angle between the lever portion 30L and the release arm portion 30R of about 180 degrees (as shown), but this can vary substantially depending upon the physical requirements of the spray device 10. In an alternative embodiment it is contemplated that the angle will be varied from a few degrees to almost 180 degrees. In another alternative embodiment, the release arm is formed by a cam surface (with increasing radius around the circumference) that intersects the ribs, as described below, or equivalent ribs. The term "lever" is used herein to include any body that pivots about a fulcrum, and includes at least elongated, round and elliptical bodies.

Each arm of the release arm portion 30R extends from the pivot 32 along the lateral sidewall of the shroud 24, and traverses a path during pivoting of the lever 30 that includes the front ends of the ribs 36. The ribs 36 extend laterally inwardly from the shroud 24 a few millimeters, and the arms of the release arm portion 30R impact the front ends of the ribs 36 near an extreme end of the lever's pivot path. The shroud 24 is cut away from the ribs 36 in FIGS. 8 and 11 to show the internal components that are not otherwise visible, as shown in FIGS. 1-4 and 6. Of course, the person having ordinary skill will recognize that the ribs 36 could be replaced by a pin that extends the entire distance between the sides of the shroud 24, and the release arm portion 30R could be narrower and only contact the pin in the center. However, more material would be necessary for such a structure, and that could increase costs. Any structure that would provide the function of the ribs 36 is contemplated as a substitute for the ribs 36, and is encompassed by the terms "rib" and "ribs".

Figure 3:
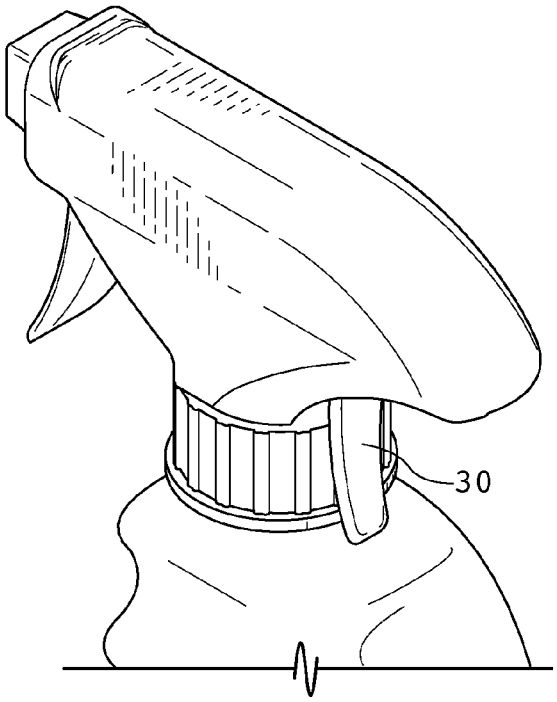
FIG. 3 is a rear, close-up view in perspective illustrating the embodiment of FIG. 1 with the lever in the downward position in which the trigger is released to be moved.
Figure 4:
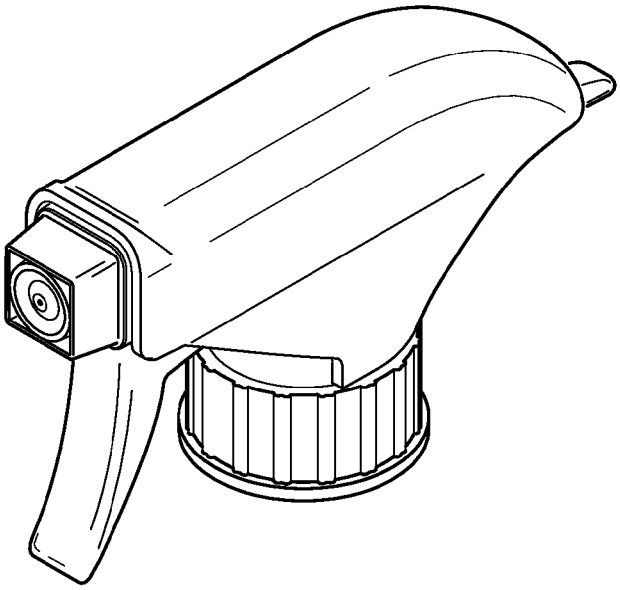
FIG. 4 is a front, close-up view in perspective illustrating the spray device of FIG. 1.

As noted above, the lever 30 can be pivoted downwardly from the resting position shown in FIG. 2 to a lower position shown in FIG. 3. This is preferably carried out by a person placing the web of his or her hand that extends between the thumb and first digit onto the shroud 24 and sliding downwardly until the tip of the lever 30 rests beneath the web. With a gentle downward force on the tip, the lever 30 is displaced downwardly slightly until it separates from the shroud 24. The release arm portion 30R is simultaneously displaced upward toward the ribs 36.

Figure 9:
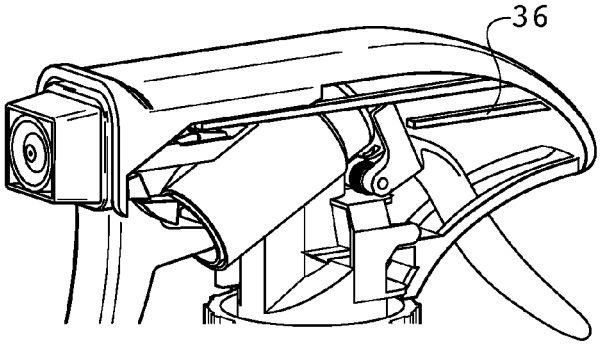
FIG. 9 is a cutaway view in perspective illustrating the spray device of FIG. 6 in the trigger lock position with the lever depressed slightly.
Figure 10:
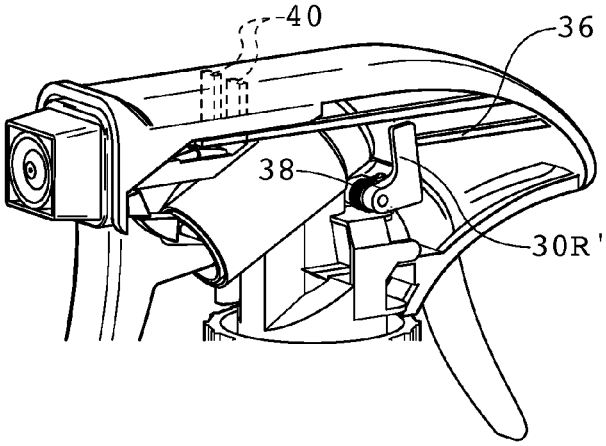
FIG. 10 is a cutaway view in perspective illustrating the spray device of FIG. 6 in the trigger lock position with the lever depressed farther than in FIG. 9 but not completely.
Figure 11:
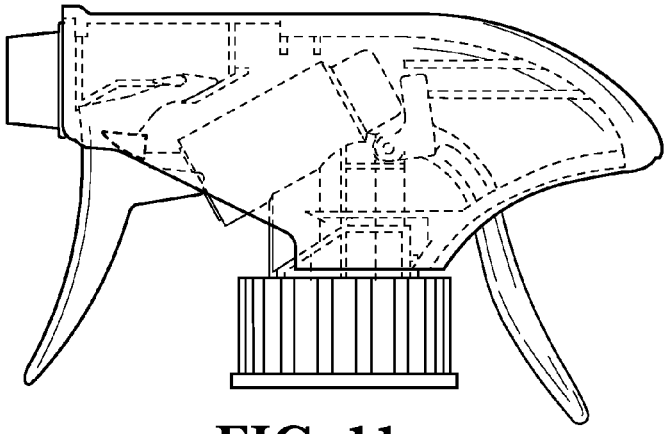
FIG. 11 is a side view illustrating the spray device of FIG. 6 in the trigger lock position with the lever depressed as in FIG. 10 and with the shroud transparent.

The downward movement of the lever 30 is shown in sequence in FIGS. 8-10. While the lever portion 30L moves downwardly, the arms of the release arm portion 30R are simultaneously displaced upwardly about the pivot 32. Upon pivoting of the lever 30 to the position shown in FIG. 10, the release arm portion 30R' makes contact with the ribs 36. Only contact with one rib 36 is shown in FIG. 10, but because the arms 30R' and 30R" are angled identically relative to the lever portion 30L, the ribs 36 are contacted by the arms simultaneously.

Until the point shown in FIG. 10, the only force necessary to pivot the lever 30 is a force required to overcome the torque applied by the torsion spring 38 (see FIG. 10) that extends around the pivot 32. This torsion spring 38 is pre-stressed and has one end seated against the frame 14 and the other end seated against the lever 30 to return the lever 30 to the rest position shown in FIG. 7 unless sufficient force is applied to the lever portion 30L. In order to move the lever 30 from the rest position to the ribs-abutting position shown in FIG. 10, one must merely apply a force to the lever portion 30L sufficient to overcome the torque applied by the spring 38 and any system friction. Upon further downward pivoting of the lever 30 past the point shown in FIG. 10, one must apply a force to the lever portion 30L that is increased as will now be described.

Figure 13:
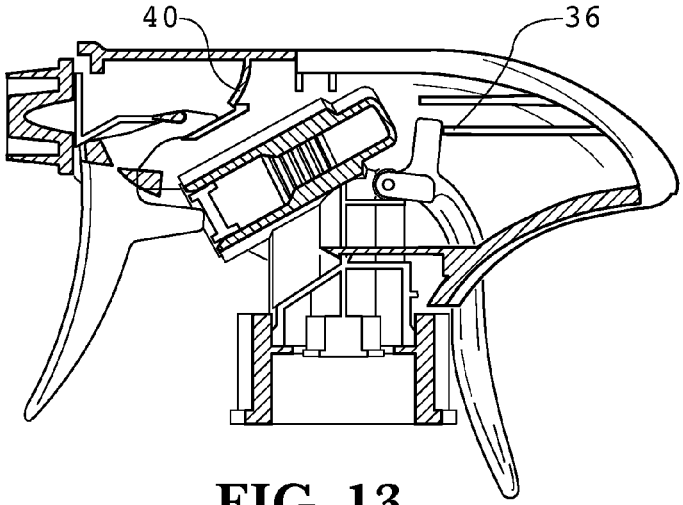
FIG. 13 is a cutaway view in perspective illustrating the spray device of FIG. 6 in the trigger release position with the lever depressed completely.

When the release arm portion 30R is displaced downwardly beyond the point shown in FIG. 10, the release arm portion 30R begins to force the ribs 36 rearwardly if the force applied to the lever portion 30L is increased sufficiently. As described above, the ribs 36 are mounted to lateral regions of the shroud 24, and the shroud 24 is slidably mounted to the frame 14 to permit rearward movement from the forward position shown in FIG. 12 (the "trigger lock" position) to a rearward position shown in FIG. 13 (the "trigger release" position). However, a bias tends to cause the shroud 24 to stay in the trigger lock position, and this bias must be overcome before the shroud 24 can be moved rearwardly. In order to bias the shroud 24 forward toward the trigger lock position shown in FIG. 12, the leaf springs 40 extend downwardly from the underside of the shroud 24 and contact the frame 14, as shown in FIGS. 12 and 13. The leaf springs 40 are flexible, yet resist deformation by a predetermined amount, thereby making them excellent at biasing the shroud 24 forward to the trigger lock position. Indeed, the bias of the springs 40 is sufficient to force the shroud 24 from the trigger release position to the trigger lock position when the lever 30 is released. Of course, any device that creates a bias could be substituted for the leave springs 40, and the term "spring" as used herein includes any equivalent structures, including at least coil, gas, magnetic and elastomeric springs.

The greater force applied to the lever 30 that is necessary to move the shroud 24 from the trigger lock position (FIG. 12) to the trigger release position (FIG. 13) includes the force sufficient to overcome the bias of the springs 40 and any friction between the shroud 24 and its connections to the frame 14. The lever portion 30L is long enough that it permits an average adult to apply a comfortable downward force to overcome the bias and thereby displace the lever 30 beyond the position shown in FIG. 12 to the position shown in FIG. 13. This downward force pushes the release arms 30R against the ribs 36 and thereby displaces the shroud 24 rearwardly a distance of about one-sixteenth of an inch to the trigger release position. Of course, this distance can be varied depending on the circumstances.

When the shroud 24 is in the trigger release position shown in FIG. 13, the trigger 18 can be moved rearwardly to dispense fluid as described immediately below. In this position, the leaf springs 40 are also elastically deformed, thereby applying a forwardly-directed force on the shroud 24 that continues to bias the shroud 24 toward the trigger lock position.

Figure 14:
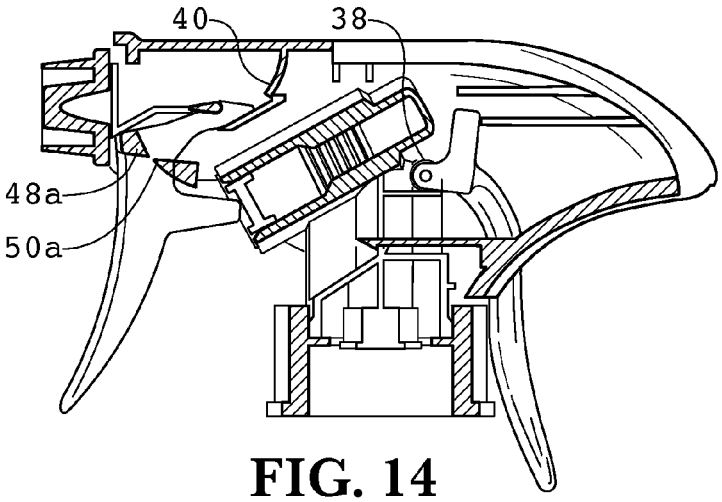
FIG. 14 is a cutaway view in perspective illustrating the spray device of FIG. 6 in the trigger release position with the trigger that has not been moved rearwardly.
Figure 15:
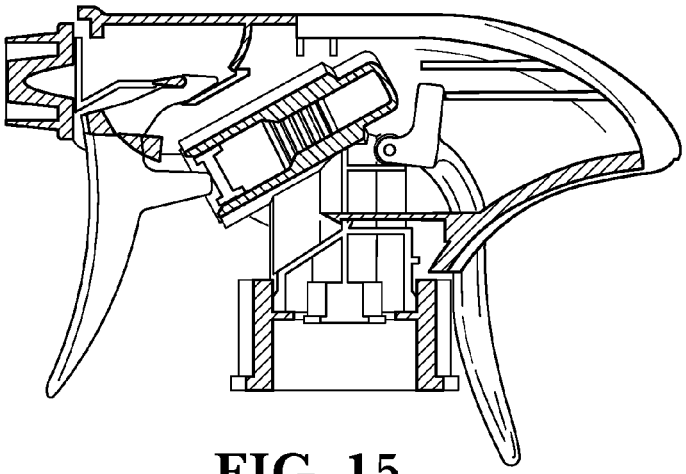
FIG. 15 is a cutaway view in perspective illustrating the spray device of FIG. 6 in the trigger release position and the trigger moved rearwardly slightly.
Figure 16:
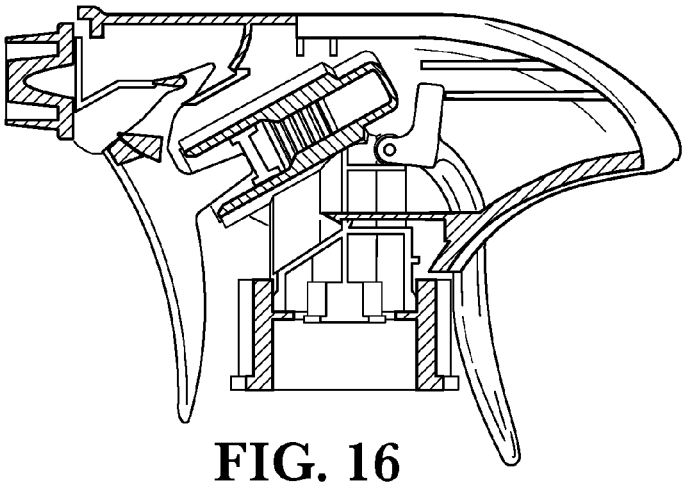
FIG. 16 is a cutaway view in perspective illustrating the spray device of FIG. 6 in the trigger release position with the trigger moved rearwardly completely.
Figure 17:
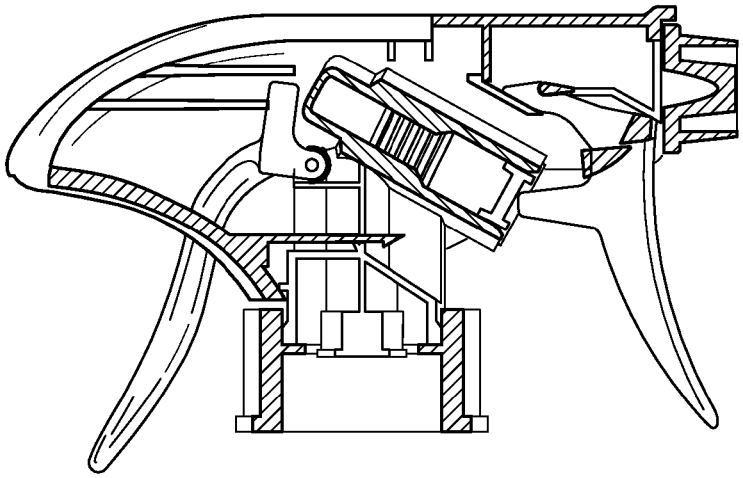
FIG. 17 is a cutaway side view illustrating the spray device of FIG. 6 from the opposite side as shown in FIG. 12.
Figure 18:
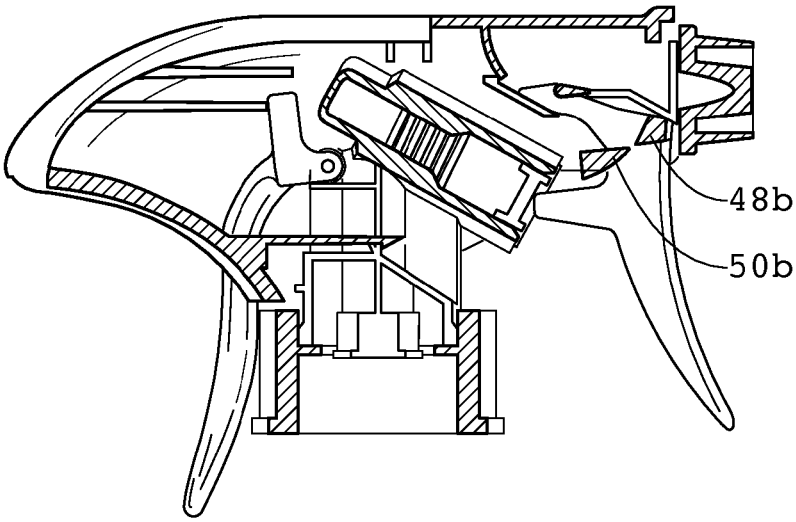
FIG. 18 is a cutaway view in perspective illustrating the spray device of FIG. 6 viewed from the opposite side as shown in FIG. 14.

As shown in FIGS. 8 and 14, the trigger 18 has at least one trigger tab 48*a* extending laterally outwardly therefrom on one side, and preferably has a second trigger tab 48*b* (see FIG. 18) extending laterally outwardly from the opposite side of the trigger 18. The tabs 48*a* and 48*b* are preferably integral to the trigger 18. Corresponding cleats 50*a* and 50*b* extend laterally inwardly from the shroud 24 in the path of the trigger tabs 48*a* and 48*b* when the shroud 24 is in the trigger lock position. When the cleats 50*a* and 50*b* are in the path of the trigger tabs 48*a* and 48*b* (see FIGS. 8-11), the trigger 18 cannot be moved rearwardly under normal conditions, because the cleats 50*a* and 50*b* obstruct the required path of travel of the trigger tabs 48*a* and 48*b*, and therefore the integral trigger 18. Thus, positioning the shroud 24 in the trigger lock position of FIG. 12 maintains the cleats in position and thereby prevents the trigger 18 from being moved sufficiently to dispense any fluid.

By displacing the shroud 24 rearwardly to the trigger release position (FIGS. 13-16), the cleats 50*a* and 50*b* are also displaced out of the path of the trigger tabs 48*a* and 48*b* (see FIGS. 14-16), thereby permitting the trigger 18 to be moved rearwardly to dispense fluid. Therefore, the device 10 at rest is locked, but once the lever 30 is displaced downwardly to the position shown in FIGS. 13-16, the shroud 24 is moved and the trigger 18 can be pulled rearwardly without obstruction. When the lever 30 is held in this most-downward position, the spray device 10 can continue to be used by merely squeezing the trigger to dispense fluid in the bottle 6 through the nozzle 22, releasing the trigger while maintaining the lever 30 in the same position and then repeating the squeezing and releasing cycle of the trigger 18. Of course, the lever 30 could be displaced and released for each pull of the trigger 18, but this is unnecessary.

A notable advantage of the invention is that the lever 30 can be held in the trigger release position by simply grasping the spray device in a conventional manner around the neck of the bottle 8 and the collar 12. In this configuration, the trigger 18 can be squeezed and released repeatedly in a normal manner by an average adult while the palm of the hand holds the lever 30 in the position shown in FIG. 3.

Because the shroud 24 slides longitudinally and the force applied to the cleats 50*a* and 50*b* by the trigger tabs 48*a* and 48*b* is transverse, and almost perpendicular, to this direction, a force applied by the trigger tabs to the cleats when the shroud 24 is in the trigger lock position will not tend to displace the shroud 24 rearwardly substantially toward the trigger release position. Thus a locked trigger cannot generally be pulled with enough force to displace the shroud 24 rearwardly. The angle between the paths of travel of the cleats and trigger tabs can be modified from that shown to make any such displacement of the shroud 24 impossible.

It will become apparent to the person having ordinary skill that if it is undesirable for the shroud 24 to be displaced, it is contemplated that any suitable structure can be extended along the inner side of a stationary shroud with cleats extending inwardly therefrom in the path of outwardly extending trigger tabs. For example, a contemplated longitudinally displaceable plastic panel can extend from the path of the release arm 30R to the paths of the trigger tabs 48*a* and 48*b*. This panel has ribs extending inwardly into the path of the release arm 30R so that sufficient pivoting of the lever 30 displaces the panel rearwardly from its trigger lock position. The rearward displacement moves corresponding cleats extending inwardly from the panel out of the paths of the trigger tabs, thereby achieving the trigger release position. Therefore, the term "shroud", while primarily referring to the shroud 24 shown in the illustrations, also includes such structural equivalents to the shroud 24 that accomplish the same purpose.

The invention can be used with any sprayed fluid, and there is no limit by the invention of the types of objects the fluid can be dispensed onto. While the lever 30 is held in the position shown in FIG. 13, the spray device 10 can be used in a manner virtually identical to a conventional sprayer.

When it is desired to cease spraying with the trigger 18, one need merely release the grip on the lever 30, collar 12 and bottle 6. Upon release of the lever 30, the spring 38 forces the lever upwardly (in the reverse order shown in FIGS. 3 through 8), thereby releasing the force applied to the rib 36 through the release arm portion 30R. This release also allows the springs 40 to bias the shroud 24 forwardly to the trigger lock position, which prevents the trigger 18 from being pulled again without further downward movement of the lever 30. The released lever 30 then moves further upward and returns under bias to the position shown in FIGS. 1 and 2.

It is important to note that the lever 30 is biased toward its rest position shown in FIGS. 1-2 and the shroud 24 is biased toward the trigger lock position. The trigger 18 cannot be pulled when the trigger lock position is engaged due to the cleats 50*a* and 50*b* obstructing the trigger tabs 48*a* and 48*b*. Because of the biases of the shroud springs 40 and the torsion spring 38, the spray head device 10 is locked, and returns to the locked configuration, until a person holds the lever 30 in the trigger release position shown in FIG. 13. Because of the biases, a spray bottle that includes the spray device 10 cannot be left unlocked and accessible to children and others who should not be dispensing the liquid therein without deliberately defeating the safety features, such as by taping the lever 30 in the trigger release position. This "automatic" return of the spray device 10 to the trigger lock position is designed to avoid many of the accidental poisonings that occur because users forget to return trigger locks and other safety mechanisms to the safe configuration.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An improved spray device having a trigger that is manually actuated to drive a pump that pumps a fluid from a container and dispenses the fluid from a nozzle connected to the pump, the spray device having a shroud extending over at least a portion of the trigger, the improvement comprising:

(a) at least one rib extending inwardly from the shroud;

(b) a lever pivotably mounted to the spray device and configured to traverse a path that intersects said at least one rib to move the shroud from a trigger lock position to a trigger release position;

(c) at least one trigger tab extending from the trigger;

(d) at least one cleat extending from the shroud in a path of said at least one trigger tab when the shroud is in the trigger lock position and configured to be out of said at least one tab's path when the shroud is in the trigger release position; and (e) a spring in contact with the shroud for biasing the shroud toward the trigger lock position.

2. The improved spray device in accordance with claim 1, wherein the lever is mounted to a pivot that defines a lever portion that extends out from the shroud on a first side of the pivot and a release arm portion that is configured to intersect the rib on a second side of the pivot.

3. The improved spray device in accordance with claim 1, wherein the spring further comprises a leaf spring extending from the shroud.

4. The improved spray device in accordance with claim 2, further comprising a torsion spring extending around the pivot and biasing the lever to a rest position.

5. The improved spray device in accordance with claim 4, further comprising at least one shroud retaining tab protruding from the shroud.

6. The improved spray device in accordance with claim 5, wherein said at least one rib comprises two ribs, each of the ribs extending inwardly from opposite sides of the shroud into the path of the release arm portion.

7. The improved spray device in accordance with claim 6, wherein said at least one trigger tab comprises two trigger tabs, each of the trigger tabs extending outwardly from opposite sides of the trigger.

8. The improved spray device in accordance with claim 7, wherein said at least one cleat comprises two cleats, each of the cleats extending inwardly from opposite sides of the shroud.

9. A method of spraying a fluid from a spray device having a trigger that is manually actuated to drive a pump that pumps fluid from a container and dispenses the fluid from a nozzle connected to the pump, the spray device having a shroud extending over at least a portion of the trigger, the method comprising:

(a) pivoting a lever mounted to the spray device to a first position, the lever thereby intersecting a rib extending inwardly from the shroud, wherein the shroud is in a trigger lock position in which at least one cleat extending from the shroud is in a path of at least one trigger tab extending from the trigger; and then (b) pivoting the lever further to a second position beyond the first position, the lever thereby moving the shroud to a trigger release position in which the cleat is out of said at least one tab's path, wherein moving the shroud overcomes a spring force that biases the shroud toward the trigger lock position; and then (c) displacing the trigger to dispense fluid from the nozzle.

10. An improved spray device having a trigger that is manually actuated to drive a pump that pumps a fluid from a container and dispenses the fluid from a nozzle connected to the pump, the spray device having a shroud extending over at least a portion of the trigger, the improvement comprising:

(a) a first rib extending inwardly from a first side of the shroud and a second rib extending inwardly from an opposite, second side of the shroud;

(b) a lever mounted to a pivot that defines a lever portion that extends from beneath the shroud on a first side of the pivot and a release arm portion that intersects the first and second ribs on a second side of the pivot, wherein the lever is configured to traverse a path that intersects the ribs to move the shroud from a trigger lock position to a trigger release position;

(c) first and second trigger tabs extending outwardly from the trigger;

(d) first and second cleats extending inwardly from the shroud in a path of the trigger tabs when the shroud is in the trigger lock position and configured to be out of the trigger tabs' path when the shroud is in the trigger release position; and (e) a spring extending from the shroud for biasing the shroud toward the trigger lock position.

11. The improved spray device in accordance with claim 10, wherein the lever portion protrudes from beneath the shroud and extends rearwardly from the pivot.

12. The improved spray device in accordance with claim 11, wherein the release arm portion extends forwardly from the pivot.

13. The improved spray device in accordance with claim 10, wherein the pump comprises a piston slidably mounted in a cylinder and the trigger has a trigger arm that extends to the piston.

14. The improved spray device in accordance with claim 10, wherein the trigger tabs extend laterally outwardly from points on the trigger over which the shroud extends.

15. The improved spray device in accordance with claim 14, wherein the cleats extend laterally inwardly from the shroud toward the trigger.

16. The improved spray device in accordance with claim 10, wherein the lever portion is configured to be adjacent a neck of the container when the shroud is in the trigger release position.

17. The improved spray device in accordance with claim 10, wherein the ribs extend from one side of the shroud to an opposite side of the shroud.

18. The improved spray device in accordance with claim 10, wherein the spring comprises a pair of leaf springs.

19. The improved spray device in accordance with claim 18, further comprising a torsion spring extending around the pivot and biasing the lever to a rest position.

20. The improved spray device in accordance with claim 19, further comprising at least one shroud retaining tab protruding from the shroud.

* * * * *